US005317950A

United States Patent [19]

Binon et al.

[11] Patent Number: 5,317,950

[45] Date of Patent: Jun. 7, 1994

[54] BULLET RESISTANT VEST

[75] Inventors: Bernard Binon, Chilly-Mazarin; Cyril Raquin, Chatenay-Malabry, both of France

[73] Assignee: Etat Francais, Ministere de l'Interieur, Direction Generale de al Police Nationale, Centre de Recherche et d'Estudes de la Logistique, Le Chesnay, France

[21] Appl. No.: 979,208

[22] Filed: Nov. 20, 1992

[30] Foreign Application Priority Data

Nov. 26, 1991 [FR] France ..... 91 14628

[51] Int. Cl.[5] ..... F41H 5/02

[52] U.S. Cl. ..... 89/36.02; 89/36.05; 2/2.5; 428/911

[58] Field of Search ..... 2/2, 2.5; 89/36.01, 89/36.02, 36.05; 428/911, 323, 325, 51; 109/80, 82, 83, 84

[56] References Cited

U.S. PATENT DOCUMENTS

| | | | |
|---|---|---|---|
| 3,577,836 | 5/1971 | Tamura . | |
| 4,198,454 | 4/1980 | Norton . | |
| 4,566,237 | 1/1986 | Turner | 428/911 |
| 4,608,717 | 9/1986 | Dunbavand | 2/2.5 |
| 4,813,334 | 3/1989 | Bloks et al. | 428/911 |
| 4,836,084 | 6/1989 | Vogelesang | 428/911 |
| 4,879,165 | 11/1989 | Smith | 2/2.5 |
| 4,989,266 | 2/1991 | Borgese et al. | 2/2.5 |
| 5,087,516 | 2/1992 | Groves | 2/2.5 |
| 5,110,661 | 5/1992 | Groves | 89/36.02 |
| 5,190,802 | 3/1993 | Pilato | 128/911 |

FOREIGN PATENT DOCUMENTS

| | | | |
|---|---|---|---|
| 0237095 | 9/1987 | European Pat. Off. | 2/2.5 |
| 9106823 | 5/1991 | PCT Int'l Appl. . | |

OTHER PUBLICATIONS

Machine Design, vol. 59, No. 10, May 7, 1987, p. 62; "One-Way Armour Allows Defenders A Shot".

*Primary Examiner*—Clifford D. Crowder
*Assistant Examiner*—Gloria Hale
*Attorney, Agent, or Firm*—Felfe & Lynch

[57] ABSTRACT

A bullet-resistant vest incorporates a breastplate which comprises at least one layer of a material which can be fractured by the effect of a deforming force upon its surface, which is placed behind a plurality of layers of classical flexible material, preferably of the polyolefin fiber type, which cover the surface of the fracturable material exposed to the deforming impact.

3 Claims, 1 Drawing Sheet

BULLET RESISTANT VEST

FIELD OF THE INVENTION

Figure 1:
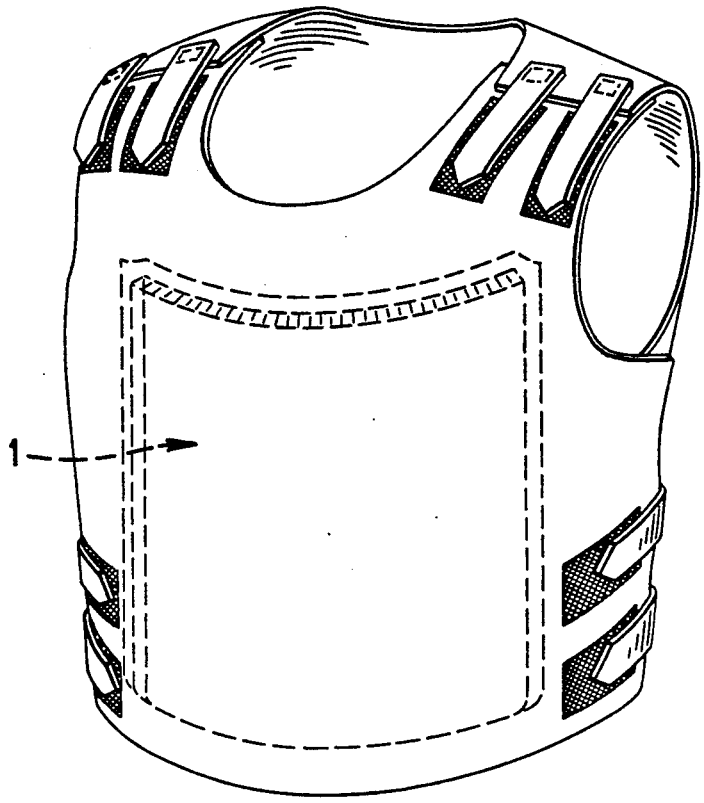

This invention relates to a novel protective armor of the type that is incorporated in garments to constitute a bullet-resistant protective lining. Such an armor is particularly intended for use in making bullet-resistant vests which are worn by police in situations in which they might be exposed to gunfire.

In this context, the invention aims essentially at making it possible to fabricate a body protection material offering sufficient protection against projectiles fired particularly from handguns, and also offering satisfactory comfort and freedom of movement. The bullet-resistant armor made of a material in accordance with the present invention can be inserted into pockets created for this purpose in different types of civilian, military and other clothing. It can also serve to constitute the bullet-stopping breastplate of a bullet-resistant vest which is otherwise of a known type.

BACKGROUND OF THE INVENTION

There has been a long search for materials for body protection against handgun projectiles for persons liable to face such dangers. Prior to the second World War the preferred armor material was steel, but using it for individual body protection is very impractical.

Research in this field was then directed toward the use of materials combining bullet-stopping properties with characteristics of pliability and lightness, so that they would be capable of giving users some degree of comfort. Thus it was that the research turned to the use of organic fibers in composite materials.

Polyamide fibers in particular are used in the manufacture of protective vests. Industrially, the fibers now involved are aramide fibers, including more particularly the phenyl-phthalamides, which are known commercially by the name of Kevlar ®. These fibers offer high resistance to elongation and high tensile strength. Consequently, bullet-resistant armor is made of one or more layers of a closely-woven fabric made from these fibers. But it has been found that in use the superposition of several layers of this fabric results in the formation of wrinkles in which a bullet can become lodged. This defect is remedied by stitching these layers of aramide fibers to one another.

In general, the probability that a projectile will be stopped by a pliable protective material depends on the type of armor, the velocity of the projectile, as well as various other parameters such as the type of cartridge, the more or less dry or humid atmospheric conditions, etc. The result is that the body armor is generally designed to counter specific dangers, and is limited to a specific velocity range on the basis of armor standards and of the anticipated danger.

DESCRIPTION OF THE INVENTION

The subject matter of the present invention is a bullet-resistant body armor useful particularly against bullets fired from handguns, which has incorporated within it at least one layer of a material which can be fractured by the effect of a deforming force upon its surface which is placed behind layers of classical, flexible material, preferably of the polyolefin fiber type, which cover the surface of the said material exposed to the impact.

Within the scope of the present invention it is particularly desired that, upon the impact of a projectile travelling at 400 to 500 m/sec the body armor satisfies two requirements: first, stop the projectile by dissipating the energy converted into a deformation effort, but secondly also that it should not result in excessive deformation of the armor so as to prevent any trauma connected with the impact.

Thus, instead of providing protection by means of a limited flexibility of an armor which would consist solely of stacked sheets of a flexible material of polyolefin or polyamide fibers, the body armor according to the present invention provides a layer of material which opposes this deformation by fracturing immediately under impact and thus forming an empty space in which the deformation of the deformable layers can take place and thus prevent a traumatizing deformation of the back of the bullet-resistant armor.

Polyolefin fibers of very high molecular weight are already being used in body armor. They result in materials which offer a very high strength-to-weight ratio and thus have a high stopping power. The polyolefin fibers, most often polyethylene, have a high velocity of wave propagation (12,300 m/sec) which absorbs and disperses the impact energy of a projectile over a maximum area.

If only sheets of polyethylene fibers are used, the bullet-resistant armor must comprise at least 45 sheets of polyethylene in order to reduce the deformation caused by the impact sufficiently from one side to the other of the total thickness of the armor. If it is desired to improve the characteristics relating to wearing comfort or to invisibility of the material inserted into civil garments, the problem can be solved only by reducing the thickness of the armor, but then the deformation of the internal surface is increased which results in the risk of trauma from the impact.

The bullet-resistant armor of the present invention makes it possible to get along with a lesser thickness of flexible material of the polyethylene fiber sheet type, not exceeding generally about 30 to 35 sheets, due to the fact that a layer of material is incorporated therein whose walls are fracturable and thus, even with a lesser total thickness, provides the same protection against trauma caused by the impact of a projectile.

In comparison with polyamide fibers, the polyolefin fibers and especially those of polyethylene have better performance characteristics, such as toughness and elasticity, at a significantly lower density than that of polyamide fibers such as Kevlar ®. Thus, in the case of polyethylene fibers the toughness (PSI) is on the order of $375\times10^3$ to $435\times10^3$, whereas the toughness of polyamide fibers is on the order of $273\times10^3$. The elasticity modulus (PSI) of the polyethylene fibers varies from $17.4\times10^6$ to $24.8\times10^6$, whereas the elasticity modulus for the polyamides is $9.8\times10^6$.

The polyethylene fibers are used either in the form of a woven fabric or in the form of a nonwoven fabric. The nonwoven fabric takes the form of a sheet composed of a layer of polyethylene fibers laid in one direction and another layer of fibers laid in another direction. The two layers of fibers are bonded with a resin in orientations of 0° and 90° for example.

The layers of polyethylene fibers are then covered with a film of a pliable thermoplastic resin. It is also possible to overlay more than two layers of polyethylene fibers to make sheets of different thicknesses. The sheets thus formed have the advantage of overcoming the wrinkling to which the fabrics are subjected, which reduces the ability of the system to remain under tension and immediately absorb the energy of the projectile. Furthermore, these sheets provide a uniform distribution of the stresses in the directions of the fibers, unlike woven systems in which the stresses are absorbed locally.

Unlike the fixed system, the fiber layer construction also makes it possible for many more fibers to come in contact with a projectile upon the initial impact. The resin bonding of the fibers keeps them in place under the shock wave of the projectile which tries to push them out of its path.

The capacity for absorbing and dispersing the impact energy of a projectile is provided by the flexibility of the polyolefin fiber sheets, by their ability to stretch, and by the better distribution of the stresses caused by the fiber layer structure of the sheets.

A secondary characteristic of the bullet-resistant armor according to the present invention is the layer of fracturable material with a cellular structure, especially of the honeycomb type, the walls of which are preferably made of an organic material so that the fracturable material has good mechanical strength while at the same time remaining dynamically fragile.

The fragility under dynamic stresses enables the fracturable material to fracture immediately and thus provide an empty space which permits the deformed portion of the deformable layers to enter it and thus resist in a particularly advantageous manner the continuation of the deformation, and thereby avoid any risk of trauma that would no longer be due to the projectile itself but due to the deformation which the projectile causes as it penetrates and stops in the flexible, homogeneous layers.

The layer of fracturable material may be formed by a honeycomb structure with nonmetallic fracturable walls, which forms generally hexagonal cells opening at the surface of the layer, but equivalent materials can be used as an alternative, such as an assembly of several thicknesses of plastic bubble wrap which burst under the pressure exerted by the deformation of the bubble wrap plastic layers and thus create a void.

According to a preferred embodiment of the present invention, such a nonmetallic honeycomb layer is made of polyamide resin paper, especially a phenyl phthalamide resin paper, such as that currently available in commerce under the name Nomex ®, which is impregnated with a phenolic resin. This material, because of the bond created between the arylamide fibers and the phenolic resin, has high mechanical and compressive strength and high resistance to shock, vibration and fatigue. Honeycombs having a hexagonal cell diameter of 3.2 to 4.0 mm are preferably used, for a density on the order of 24 to 29 kg/m$^3$. The preferred honeycombs have a thickness on the order of 3 to 4 mm.

It should be noted in this respect that, although this material is well known to specialists in the industrial areas where its compressive strength qualities are used, such as aviation, racing cars, skis or the shipbuilding industry, its use in conjunction with the present invention utilizes its qualities in an entirely different manner. Actually, it is the dynamic fragility of this material which gives it the properties suitable for incorporation in a cellular structural form in bullet-resistant armor and provide good protection.

Ballistic tests conducted with the bullet-resistant armor of the present invention have shown a destruction of the armor over approximately 1 cm of diameter, whereas in the case of a bullet-resistant armor made with arylamide fibers the destruction of the armor takes place over a surface of 2 to 4 cm of diameter. Therefore, it is evident that the cone of deformation is significantly reduced due to the particular structure of the bullet-resistant material according to the present invention.

In a variant embodiment of the bullet-resistant armor of the present invention, it is advantageous to use sheets of polyolefin fibers and woven structures of polyolefin or polyamide for making the covering layers of the fracturable wall material. Thus, the sheets of fiber layers provide flexibility while the woven structures offer certain resistance due to their great rigidity, but the fracturable wall material still serves the same purpose. In another embodiment of the bullet-resistant armor according to the present invention, it is advantageous to use a layer of honeycomb and a layer of plastic bubble wrap as the fracturable material.

The attached drawings illustrate the present invention and will enable others skilled in the art to understand it more completely. It should be understood, however, that the invention is not limited solely to the embodiment shown in the drawings, of which FIG. 1 is a perspective view of a bullet-resistant vest with a breastplate which incorporates the layered structure of the bullet-resistant armor of the present invention, and FIG. 2 is an exploded perspective view in partial section of the layered bullet-resistant armor structure in accordance with the present invention.

Figure 2:
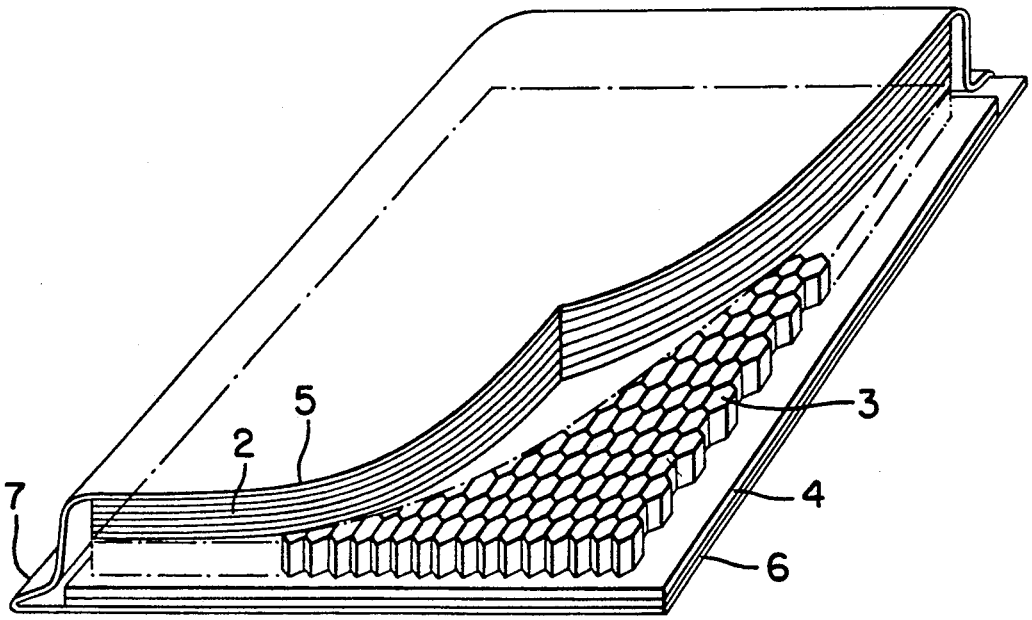

The vest shown in FIG. 1 comprises a breastplate 1. FIG. 2 shows that, starting from the face which is first exposed to the projectile impact, the breastplate comprises a succession of a large number—on the order of some thirty—superimposed homogeneous thin layers 2 of polyethylene which in turn cover a thicker layer of fracturable material 3 having a honeycomb structure of hexagonal cells with walls perpendicular to the surface of the breastplate, and thereunder a smaller number of two or three other fine, homogeneous layers of polyethylene 4 and 6. On the edges of the bullet-resistant armor the end polyethylene layers 5 and 6 are attached to one another all around the breastplate, either by stitching or preferably by thermal welding to hold the assembly together. For this purpose the first of the outer surface polyethylene layers 5 is extended to flexibly envelop the assembly, the fracturable layer 3 of which is relatively stiff, until it again reaches the opposite end layer 6 which slightly overlaps the internal intermediate layers along edge 7 which remain free within the envelope thus formed.

When used for protection particularly against gunfire in bursts, the sheets of polyethylene fibers are preferably stitched together so as to prevent any separation between the sheets in the thickness at the moment of impact, which might then cause a reduction of the effectiveness of the system to the extent that only the surface sheets would be working.

While the present invention has been illustrated with the aid of a certain specific embodiment thereof, it will be readily apparent to others skilled in the art that the invention is not limited to this particular embodiment, and that various changes and modifications may be made without departing from the spirit of the invention or the scope of the appended claims.

We claim:

1. A bullet-resistant armor plate composite consisting of an impact and energy absorbing layer having a front surface and a rear surface said energy absorbing layer being formed by a first bonded stack of a plurality of flexible sheets of polyethylene; a fracturable honeycomb cellular structure layer having a front side and rear side made of polyamide fiber paper impregnated with a phenolic resin, said front side of said fracturable layer being in contact with the rear surface of said impact and energy absorbing layer, and a second bonded stack of a plurality of polyethylene sheets in contact with the rear side of said fracturable honeycomb layer.

2. A bullet-resistant armor of claim 1, wherein the stacked flexible sheets of polyethylene of said impact and energy absorbing layer are stitched together.

3. A bullet-resistant armor of claim 1, wherein the stacked flexible sheets of polyethylene of said impact and energy absorbing layer are bonded by impregnation with a resin.

* * * * *